US006598247B1

(12) United States Patent
Heimbrock et al.

(10) Patent No.: US 6,598,247 B1
(45) Date of Patent: Jul. 29, 2003

(54) STRETCHER WITH MECHANICAL POWER ASSIST

(75) Inventors: Richard H. Heimbrock, Cincinnati, OH (US); Jonathan D. Turner, Dillsboro, IN (US); Stephen R. Hamberg, Cincinnati, OH (US); D. Scott Manlove, Osgood, IN (US); Donald E. Smith, Greensburg, IN (US); Robert Mark Zerhusen, Cincinnati, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 09/688,540

(22) Filed: Oct. 16, 2000

Related U.S. Application Data

(60) Provisional application No. 60/161,791, filed on Oct. 27, 1999.

(51) Int. Cl.[7] ..... A61G 1/02

(52) U.S. Cl. ..... 5/86.1; 5/600; 296/20

(58) Field of Search ..... 5/86.1, 81.1 R, 5/600, 625; 296/20; 280/43, 43.17

(56) References Cited

U.S. PATENT DOCUMENTS

| | | | | | |
|---|---|---|---|---|---|
| 2,563,919 | A | * | 8/1951 | Christensen | 280/43.18 |
| 2,935,331 | A | * | 5/1960 | Ledgerwood | 280/79.3 |
| 3,304,116 | A | * | 2/1967 | Stryker | 296/20 |
| 4,164,355 | A | * | 8/1979 | Eaton et al. | 296/20 |
| 5,279,010 | A | * | 1/1994 | Ferrand et al. | 5/600 |
| 5,348,326 | A | * | 9/1994 | Fullenkamp et al. | 280/43.17 |
| 5,802,640 | A | * | 9/1998 | Ferrand et al. | 5/617 |
| 5,806,111 | A | * | 9/1998 | Heimbrock et al. | 5/86.1 |
| 5,906,016 | A | * | 5/1999 | Ferrand et al. | 5/600 |
| 5,906,017 | A | * | 5/1999 | Ferrand et al. | 5/617 |
| 5,987,671 | A | * | 11/1999 | Heimbrock et al. | 5/600 |
| 6,016,580 | A | * | 1/2000 | Heimbrock et al. | 5/86.1 |
| 6,230,343 | B1 | * | 5/2001 | Buiskool et al. | 5/610 |
| 6,240,579 | B1 | * | 6/2001 | Hanson et al. | 5/86.1 |
| 6,256,812 | B1 | * | 7/2001 | Bartow et al. | 5/86.1 |
| 6,264,006 | B1 | * | 7/2001 | Hanson et al. | 188/1.12 |
| 6,286,165 | B1 | * | 9/2001 | Heimbrock et al. | 5/600 |
| 6,330,926 | B1 | * | 12/2001 | Heimbrock et al. | 180/65.5 |
| 6,421,854 | B1 | * | 7/2002 | Heimbrock | 5/86.1 X |
| 6,438,776 | B2 | * | 8/2002 | Ferrand et al. | 5/600 |
| 6,505,359 | B2 | * | 1/2003 | Heimbrock et al. | 5/86.1 |
| 2001/0029628 | A1 | * | 10/2001 | Ferrand et al. | 5/600 |
| 2001/0039679 | A1 | * | 11/2001 | Heimbrock et al. | 5/86.1 |

* cited by examiner

*Primary Examiner*—Robert G. Santos
(74) *Attorney, Agent, or Firm*—Barnes & Thornburg

(57) ABSTRACT

A mechanism for initiating movement of a stretcher includes a drive wheel, and a lever or pedal actuated assembly. Moving the pedal or the lever moves a flexible drive link which is wound around a hub of the drive wheel. As the flexible drive link is pulled and unwound from the hub, the drive wheel engages the floor and rotates a sufficient distance to overcome inertia and align the swivel wheels of the stretcher in the desired direction.

27 Claims, 3 Drawing Sheets

STRETCHER WITH MECHANICAL POWER ASSIST

This application claims the benefit of U.S. Provisional Patent Application, Serial No. 60/161,791, filed on Oct. 27, 1999, and entitled "Stretcher with Mechanical Power Assist".

BACKGROUND AND SUMMARY OF THE INVENTION

The present invention relates to a hospital bed, chair, cart, stretcher or a similar patient support apparatus. More particularly, the present invention relates to a patient support apparatus having wheels or casters, and which is typically manually pushed.

In hospitals, it can be difficult for a caregiver to push a stretcher having a patient supported thereon without the assistance of another person. Overcoming the inertia of a stationary stretcher and swiveling the casters of the stretcher to point in the desired direction of travel can take considerably more effort than maintaining the momentum of a moving stretcher. Overcoming the inertia and aligning the wheels of a stretcher can be difficult enough when pushing the stretcher on a smooth horizontal floor of a hospital. The problem is even more difficult when the stretcher has to be pushed up a ramp in field situations. In both the hospital and field use, caregivers can injure their backs while pushing a stretcher with a patient supported thereon.

According to the present invention, a manually-operated power assist mechanism assists caregivers in overcoming the inertia and aligning the wheels when pushing a stretcher or a similar patient support apparatus.

In preferred embodiments, a patient support apparatus includes a frame, a patient support deck carried by the frame, a drive wheel coupled to the frame, and a manually-operated power assist mechanism configured to drive the drive wheel, and initiate motion of the patient support apparatus. In some embodiments, the manually-operated power assist mechanism is configured to lower the drive wheel to engage the floor, and drive the drive wheel to move the patient support apparatus.

In two of the illustrative embodiments, the manually-operated power assist mechanism comprises a foot-operated power assist mechanism. In another illustrative embodiment, the manually-operated power assist mechanism comprises a hand-operated power assist mechanism.

According to another aspect of the present invention, a method of moving a patient support apparatus includes the steps of providing the patient support apparatus with a drive wheel and a lever-actuated mechanism configured to drive the drive wheel, and actuating the lever-actuated mechanism to overcome inertia and propel the patient support apparatus.

Additional features, and advantages of the invention will become apparent to those skilled in the art upon a consideration of the following detailed description of preferred embodiments exemplifying the best mode of carrying out the invention as presently perceived.

BRIEF DESCRIPTION OF DRAWINGS

The invention will be described hereafter with reference to the attached drawings which are given by way of non-limiting examples only, in which.

DETAILED DESCRIPTION OF THE DRAWINGS

The illustrative power assist mechanism will be hereinafter described with reference to a stretcher. However, it is to be understood that the illustrative power assist mechanism is not limited for use in conjunction with a stretcher, but is applicable to a hospital bed, chair, cart or a similar patient support apparatus. Thus, the term "stretcher" throughout the specification and claims is intended to cover all of these and similar devices. In addition, although not described in detail below, it is understood that the beds, chairs, carts and stretchers incorporating the illustrative power assist mechanism can, in addition, have articulated decks, side rails, braking and steering mechanisms, and other features.

The illustrative manually-operated power assist mechanism causes a drive wheel of a stationary stretcher to rotate, and thus initiate movement of the stretcher to overcome inertia, and straighten out the swivel wheels if necessary. In a stretcher equipped with a steering wheel, the illustrative power assist mechanism can be adapted to lower the steering wheel into engagement with the floor, and drive the steering wheel to initiate movement of the stretcher. Reference may be made to U.S. Pat. No. 5,806,111 for illustration of a stretcher having a steering wheel, which patent is incorporated herein in its entirety by reference.

Figure 1:
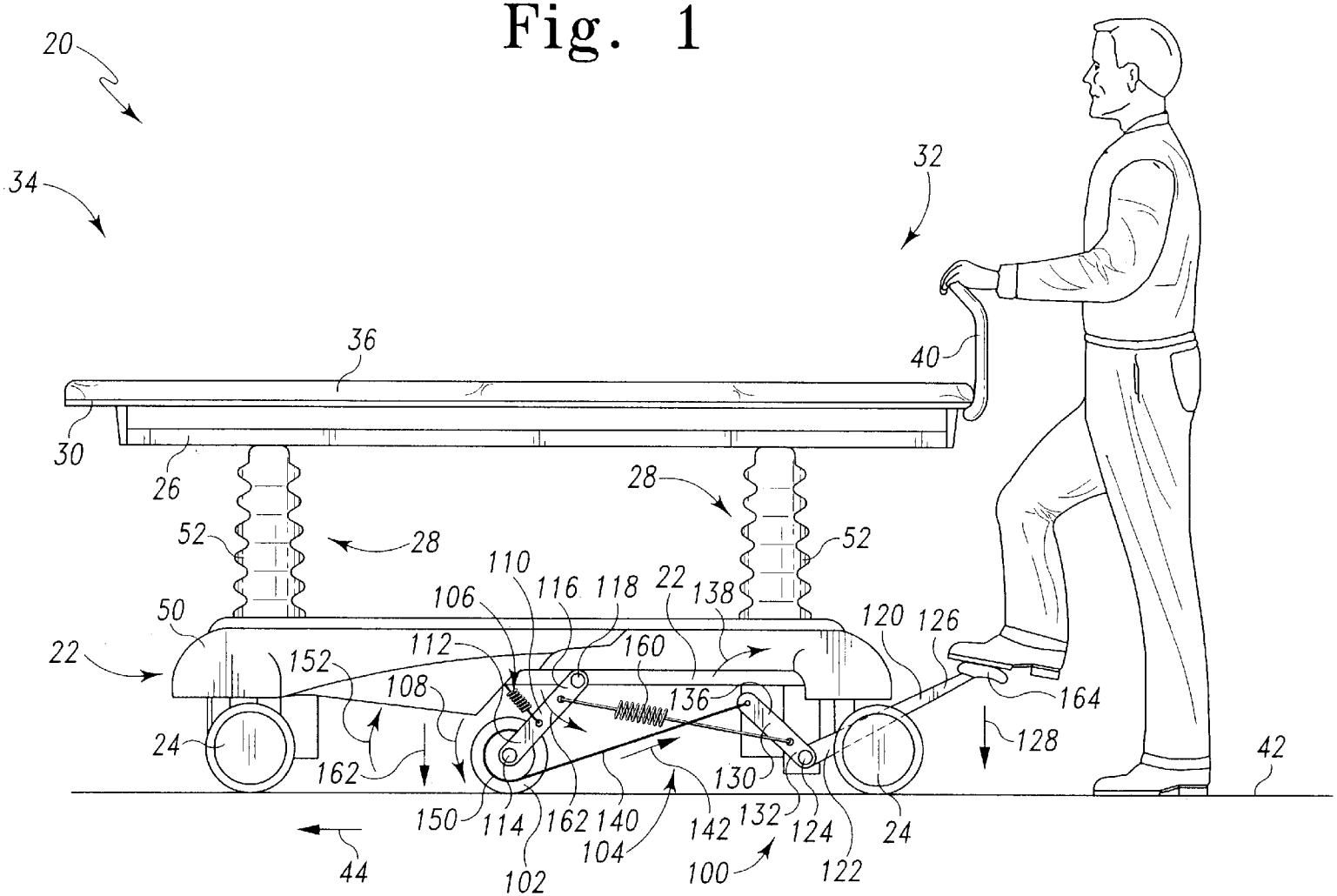
FIG. 1 is a schematic side view of a stretcher equipped with an illustrative foot-operated power assist mechanism.

FIG. 1 is a schematic side view of a stretcher 20 with an illustrative foot-operated power assist mechanism 100. The stretcher 20 includes a lower frame 22 (sometimes referred to herein as base) supported on a set of four swivel casters or wheels 24, an intermediate frame 26 supported above the lower frame 22 by a pair of longitudinally spaced-apart elevation mechanisms 28, and an articulatable upper frame 30 (sometimes referred to herein as upper deck or patient support deck) supported above the intermediate frame 26. The upper frame 30 has a head end 32, a foot end 34 and a longitudinal axis (not shown). The stretcher 20 includes a mattress 36 supported on the upper deck 30 for supporting a patient. The stretcher 20 includes a push handle 40 near the head end 32 that can be grasped by a caregiver to push the stretcher 20 along a floor 42 in a forward direction 44.

The lower frame 22 is covered by a shroud 50. The swivel casters 24 extend downwardly from the lower frame 22 to engage the floor 42 on which the stretcher 20 rests. The elevation mechanisms 28, well-known to those skilled in the art, are each covered by a boot 52. The stretcher 20 includes a plurality of foot pedals (not shown) that are coupled to the elevation mechanisms 28. Different foot pedals can be depressed to actuate the elevation mechanisms 28 to raise, lower, and tilt the intermediate frame 26 and the upper deck 30 relative to the floor 42.

The stretcher 20 also includes a longitudinally-extending brake-steer shaft (not shown). The brake-steer shaft is coupled to a conventional caster braking mechanism (not shown), well known to those skilled in the art. The caster braking mechanism brakes the casters 24 to prevent them from rotating and swiveling when the brake-steer shaft is rotated to a braking position. The brake-steer shaft may also be coupled to a conventional steering wheel mechanism (not shown), also well known to those skilled in the art. When the brake-steer shaft is rotated to a steering position, the steering wheel mechanism presses a steering wheel (not shown) into engagement with the floor 42 to assist in steering the stretcher 20. For further details, a reference may be made to the U.S. Pat. No. 5,806,111 issued to Heimbrock et al., and incorporated herein in its entirety by reference.

The power assist mechanism 100 includes a pivotally-mounted drive wheel 102 and a linkage assembly 104. The drive wheel 102 is movable between an inoperative first position where the drive wheel 102 is spaced apart from the floor 42, and an operative second position where the drive wheel 102 is pressed against the floor 42. A spring 106 normally biases the drive wheel 102 in the raised inoperative position spaced apart from the floor 42. When operated, the linkage assembly 104 serves to both lower the drive wheel 102 into engagement with the floor 42, and to rotate the drive wheel 102 in direction 108 to propel the stretcher 20 along the floor 42 in forward direction 44.

The linkage assembly 104 includes a bracket 110, the lower end 112 of which rotatably supports the drive wheel 102 about a pivot pin or axle 114. The upper end 116 of the wheel bracket 110 is coupled to the lower frame 22 for pivotal movement about a pivot pin 118. The bracket 110 is sturdy enough to withstand the force generated when initiating movement of the stretcher 20 along the floor 42. When lowered, the bracket 110 is configured to position the drive wheel 102 near the center of the footprint of the stretcher 20.

The linkage assembly 104 further includes a foot pedal 120, the lower end 122 of which is coupled to the lower frame 22 for pivotal movement about a pivot pin 124 near the head end 32 of the stretcher 20. The upper end 126 of the foot pedal 120 carries a pad 164. When operated, the foot pedal 120 is configured to pivot in a downward clockwise direction 128. A pedal arm 130 has a lower end 132 attached to the lower end 122 of the foot pedal 120 so that when the foot pedal 120 is pivoted in the clockwise direction 128, the pedal arm 130 is rotated in the same angular direction 138 about the pivot pin 124. It is to be understood that the lower ends 122, 132 of the foot pedal 120 and the pedal arm 130 can be attached to each other, or, in the alternative, can be attached to a common shaft or rod (not shown) having an axis which is aligned with the pivot pin 124.

A cable 140 (also referred to herein as flexible drive link) extends from the upper end 136 of the pedal arm 130, and wraps, at least partially, around a hub 150 of the drive wheel 102. Although a cable is used in this embodiment, one may as well use a belt, toothed or smooth web, chain or a similar member. The hub 150 can be in the form of a spool, sprocket, pulley, etc. The hub 150 cooperates with the cable 140 to rotate the drive wheel 102 in direction 108 when the cable 140 is pulled by the pedal arm 130 in direction 142. The hub 150 includes a return spring (not shown) of a conventional design to rotate the hub 150 in a reverse direction 152 to rewind the cable 140 back onto the hub 150, after the foot pedal 120 is released and the drive wheel 102 is raised above the floor 42 by the return spring 106.

Another spring 160 is connected between the pedal arm 130 and the wheel bracket 110. When the foot pedal 120 is pressed down in direction 128, the spring 160 pulls on the wheel bracket 110 in direction 162 to lower the drive wheel 102 into engagement with the floor 42. When the foot pedal 120 is released, the springs 106, 160 return the drive wheel 102, the wheel bracket 110, and the foot pedal 120 to their respective raised inoperative positions. The return spring 160 can be a bungee cord, shock cord, spring biased member, fluid piston, etc.

In operation, the caregiver steps on the foot pedal 120 to initiate movement of the stretcher 20. As the foot pedal 120 is depressed, it rotates about the pivot pin 124 in clockwise direction 128, causing the pedal arm 130 to also pivot about the pivot pin 124 in clockwise direction 138. As the pedal arm 130 pivots in direction 138, the spring 160 pulls on the wheel bracket 110 in direction 162 until the drive wheel 102 engages the floor 42. Also as the pedal arm 130 pivots about the pivot pin 124, the pedal arm 130 pulls the cable 140 in direction 142. This, in turn, unwinds the cable 140 from the hub 150, causing the drive wheel 102 to rotate in direction 108, and propelling the stretcher 20 in forward direction 44.

The position and length of the foot pedal 120, the position and length of the pedal arm 130, the position and length of the wheel bracket 110 and the length of the cable 140 can be configured so that after engaging the floor 42 the drive wheel 102 will rotate a sufficient distance to align the swivel wheels 24, and propel the stretcher 20 in forward direction 44. When the foot pedal 110 is released, the return springs 106, 160 return the wheel bracket 110, the drive wheel 102, the pedal arm 130 and the foot pedal 120 to their respective raised inoperative positions. At this point, the stretcher 20 is in motion, and the caregiver simply continues the movement of the stretcher 20 by pushing the stretcher 20 with the hands and the upper body.

Because the stretcher 20 moves while stepping down on the foot pedal 120, the illustrated foot-operated power assist mechanism 100 lends itself to a walking stride of the caregiver which is completed as the caregiver's foot is removed from the foot pedal 120 in a natural stride. The pad 164 attached to the foot pedal 120 protects the floor 42 at the bottom of the pedal stroke. Those skilled in the art will appreciate that the illustrated power assist mechanism 100 may well be used in conjunction with a stretcher having a separate steering wheel, such as the stretcher described in U.S. Pat. No. 5,806,111, which is incorporated herein in its entirety by reference. Those skilled in the art will also appreciate that a ratchet mechanism or an over-running clutch mechanism similar to the one used in coaster bicycles can be coupled between the hub 150 and the drive/steering wheel 102 which will allow the drive/steering wheel 102 to rotate freely in both directions to facilitate steering of the stretcher 20 when not driven by the cable 140.

The power assist mechanism 100 of FIG. 1 could be used to pull the stretcher 20, instead of pushing it. To this end, the foot pedal 120 could be provided at the foot end 34 of the stretcher 20, instead of at the head end 32 of the stretcher 20. The cable 140, coupled to the foot pedal 120, could be configured to pull the pedal arm 130, to, in turn, pull the stretcher 20.

Figure 2:
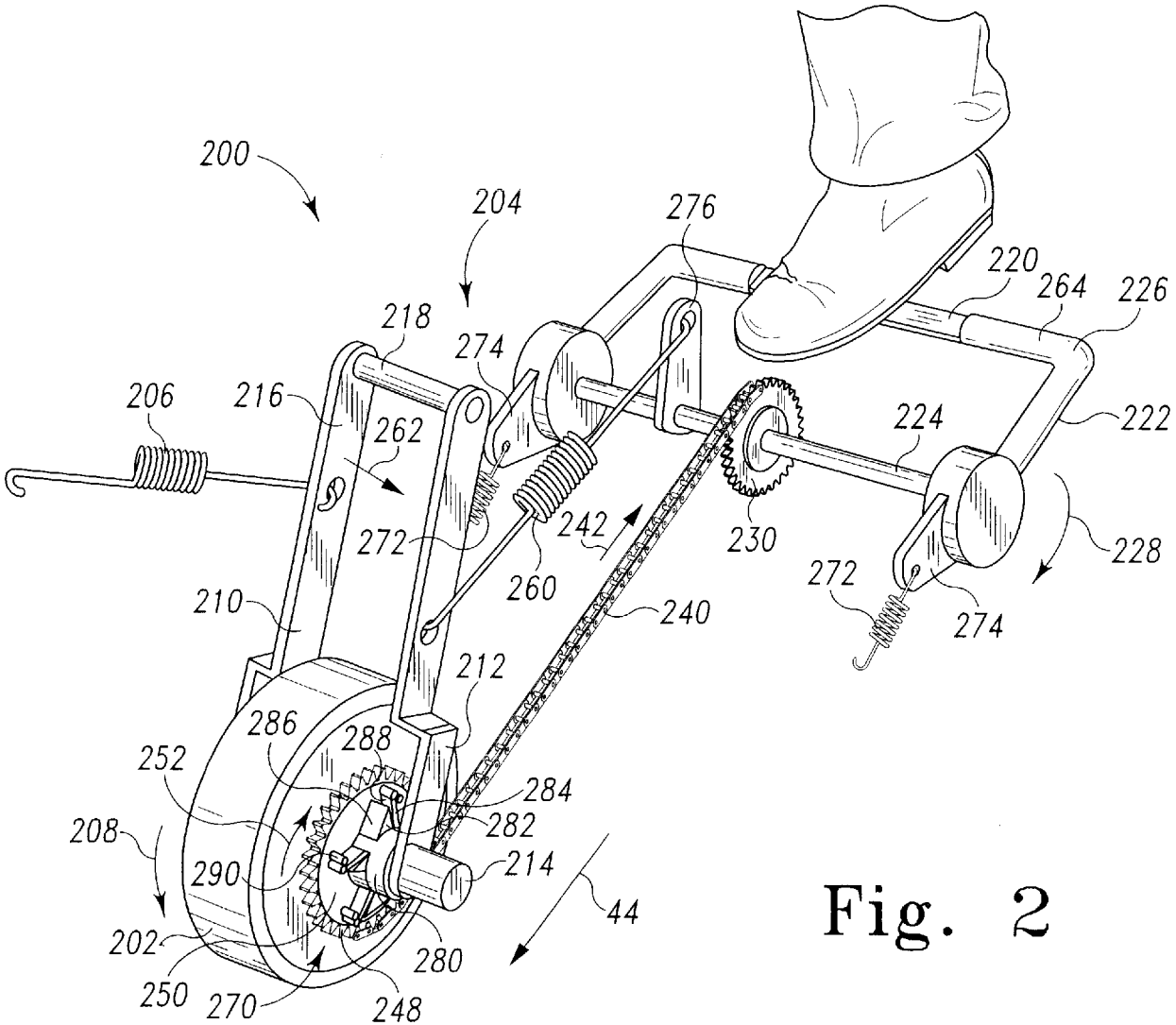
FIG. 2 is a perspective view of another illustrative embodiment of the foot-operated power assist mechanism similar to the foot-operated power assist mechanism of FIG. 1.

FIG. 2 is a perspective view of another illustrative embodiment 200 of a foot-operated power assist mechanism. Like elements in the two embodiments 100, 200 are identified by like reference numbers. For example, the drive wheel in the first embodiment 100 is identified by numeral 102, whereas the drive wheel in the second embodiment 200 is identified by numeral 202. Similarly, the foot pedal in the first embodiment 100 is identified by numeral 120, whereas the foot pedal in the second embodiment 200 is identified by numeral 220, and so on. Although the use of like reference numbers in the two embodiments 100, 200 identify similar or corresponding elements, it is understood that these elements are illustrative, and are not necessarily exactly the same.

In the FIG. 2 embodiment, a foot pedal 220 is coupled to a transversely-extending shaft 224 which rotates in clockwise direction 228 when the foot pedal 220 is depressed. The transversely-extending shaft 224 is rotatably mounted to the lower frame 22. A drive sprocket 230 is mounted on the shaft 224 for rotation therewith. A chain 240, similar to a bicycle chain, is coupled between the drive sprocket 230 and a driven sprocket 248. The driven sprocket 248 is coupled to a drive wheel 202 by an over-running clutch mechanism 270 described below. The driven sprocket 248 includes a hub 250 having a return spring (not shown) mounted therein to rotate the driven sprocket 248 in reverse direction 252 to rewind the chain 240 back onto the driven sprocket 248 when the foot pedal 220 is released. Another return spring 206 is coupled between a wheel bracket 210 and the lower frame 22 to lift the drive wheel 202 off the floor 42 when the foot pedal 220 is released. When lowered, the wheel bracket 210 positions the drive wheel 202 near the center of the footprint of the stretcher 20.

The drive wheel 202 is mounted on a pivot pin or axle 214 for rotation therewith. The pivot axle 214 is rotatably coupled to the wheel bracket 210. The over-running clutch mechanism 270 includes a hub 280 fixed to the pivot axle 214 for rotation therewith. The hub 280 is configured to form a plurality of teeth 282 on the outer periphery thereof. The teeth 282 each have a ramp surface 284 and a right angle surface 286. A like plurality of swivel plates 288 are pivotally pivotally mounted on the hub 250 of the driven sprocket 248. The plates 288 are held between the right angle surfaces 286 and corresponding stop pins 290 secured to the hub 250 of the driven sprocket 248. When the driven sprocket 248 rotates in the clockwise direction 208 in response to actuation of the foot pedal 220, the plates 288 in engagement with the right angle surfaces 286 formed on the hub 280 transfer rotary motion of the driven sprocket 248 to the hub 280. The rotation of the hub 280 is transferred to the drive wheel 202 through the common axle 214.

When the return spring (not shown) causes the driven sprocket 248 to rotate in the reverse direction 252 to rewind the chain 240, the pivotally-mounted plates 288 swing away from the stop pins 290 as they ride up the ramp surfaces 284 formed on the hub 280. This allows the driven sprocket 248 to rotate in the reverse direction 252 without hindrance from the stop pins 290 to rewind the chain 240 back onto the driven sprocket 248.

The foot pedal 220 is provided with a pair of return springs 272 which are coupled to flanges 274 appended to the shaft 224. The opposite ends of the return springs 272 are coupled to the lower frame 22. Another spring 260 is coupled between a flange 276 fixed to the shaft 224 and the wheel bracket 210. When the foot pedal 220 is released, the return springs 206, 260 and 272 serve to return the wheel bracket 210, the drive wheel 202 and the foot pedal 220 to their respective raised inoperative positions.

The foot-operated power assist mechanism 200 shown in FIG. 2 functions in substantially the same manner as the foot-operated power assist mechanism 100 shown in FIG. 1. As the caregiver steps on the foot pedal 220 to initiate movement of the stretcher 20, the foot pedal 220 rotates the shaft 224 in clockwise direction 228. As the pedal shaft 224 rotates, the flange 276 fixed to the shaft 224 also rotates in clockwise direction 228, thereby pulling on the spring 260 coupled between the flange 276 and the wheel bracket 210. The spring 260 causes the wheel bracket 210 to pivot in downward direction 262 until the drive wheel 202 engages the floor 42. Rotation of the pedal shaft 224 in clockwise direction 228 causes the drive sprocket 230 to also rotate in clockwise direction 228. The rotation of the drive sprocket 230 causes the chain 240 to be pulled in direction 242, thereby unwinding the chain 240 from the driven sprocket 248. This, in turn, causes the drive wheel 202 to rotate in direction 208, thereby propelling the stretcher 20 in the forward direction 44.

It is understood that the components of the overall linkage assembly 204, such as the length of the chain 240, the position and length of the foot pedal 220, the position and length of wheel bracket 210, and the relative diameters of the drive and driven sprockets 230, 248, etc., can be configured so that after engaging the floor 42 the drive wheel 202 will rotate a sufficient distance to align the swivel wheels 24 and propel the stretcher 20 in forward direction 44. Those skilled in the art will appreciate that increasing the radial distance between pedal shaft 224 and the foot pedal 220 increases the mechanical advantage with which the drive wheel 202 is rotated when the foot pedal 220 is depressed.

Because the stretcher 20 will move while stepping down on the foot pedal 220, the power assist mechanism 200 lends itself to a walking stride which is completed as the foot is removed from the foot pedal 220 in a natural stride. The foot pedal 220 may have a rubber casing 264 to protect the floor 42 at the bottom of the pedal stroke. It will be understood that the drive sprocket 230 may be replaced by a pedal arm 130 similar to that depicted in FIG. 1.

Figure 3:
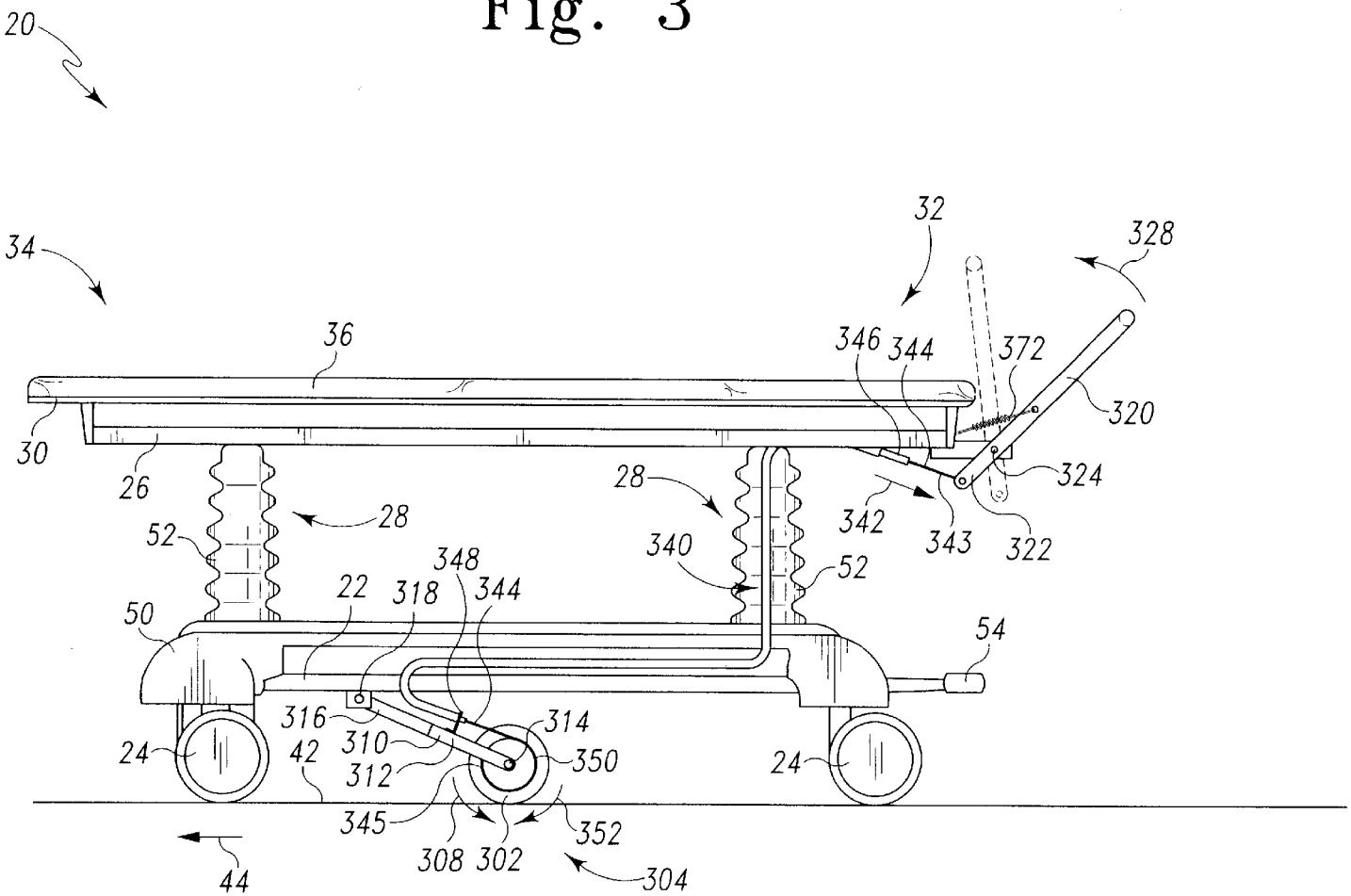
FIG. 3 is a schematic side view of a stretcher similar to FIG. 1 equipped with a hand-operated power assist mechanism.

FIG. 3 is a schematic side view of the stretcher 20 incorporating a third embodiment 300 of the illustrative manually-operated power assist mechanism. Like elements in the three embodiments 100, 200, 300 are identified by like reference numbers. For example, the drive wheel in the first embodiment 100 is identified by numeral 102, whereas the drive wheel in the second embodiment 200 is identified by numeral 202, and the drive wheel in the third embodiment 300 is identified by numeral 302, and so on.

The hand-operated power assist mechanism 300 includes a drive wheel 302, which also functions as a steering wheel to assist in steering the stretcher 20. The drive wheel 302 is coupled to the lower end 312 of a bracket 310 for rotation about a pivot pin or axle 314. The drive wheel 302 includes a hub 350 having a return spring (not shown). The upper end 316 of the wheel bracket 310 is coupled to the lower frame 22 for pivotal movement about a pivot pin 318. When lowered, the bracket 310 is configured to position the drive wheel 302 near the center of the footprint of the stretcher 20. The drive wheel 302 can be coupled to a brake-steer mechanism of the type described in U.S. Pat. No. 5,806,111 to Heimbrock et al., the complete disclosure of which is already expressly incorporated herein by reference.

The power assist mechanism 300 includes a lever or handle 320 coupled to the intermediate frame 26 near the head end 32 of the stretcher 20 for pivoting movement about a pivot pin 324. A cable 340 includes a flexible wire 344 enclosed in a flexible outer sheath 346. The upper end 343 of the wire 344 is coupled to the lower end 322 of the handle 320. The lower end 345 of the wire 344 is coupled to the hub 350 of the drive wheel 302 after wrapping at least partially around the hub 350. The sheath 346 is routed along the lower frame 22 and the wheel bracket 310 as shown, and held in place by a plurality of clips 348, one of which is shown in FIG. 3. When the handle 30 is pushed in the counterclockwise direction 328 to a position shown in phantom in FIG. 3, the upper end 343 of the wire 344 is pulled through the sheath 346 in direction indicated by arrow 342. As the upper end 343 of the wire 344 is pulled by the handle 320, the rest of the wire 344 moves within the sheath 346, and the lower end 345 of the wire 344 unwinds off of the hub 350 in direction 308. As the wire 344 unwinds off of the hub 350, the drive wheel 302 is rotated in direction 308 to propel the stretcher 20 and align the swivel wheels 24 in the forward direction 44.

When the handle 320 is released, a return spring 372 coupled between the handle 320 and the intermediate frame 26 returns the handle 320 to its home position shown in solid lines in FIG. 3. When the drive wheel 302 is lifted off the floor 42, the return spring (not shown) included in the hub 350 rotates the drive wheel 302 in reverse direction 352. As the drive wheel 302 rotates in the reverse direction 352, the wire 344 is rewound back onto the hub 350.

The length of the handle 320 can be increased to increase the force generated to overcome inertia and align the swivel wheels 24 of the stretcher 20. Although the handle 320 is positioned near the head end 32 of the stretcher 20 in the embodiment shown in FIG. 3, the handle 320 could instead be provided adjacent to the foot end 34 of the stretcher 20 to pull the stretcher 20. Also, the handle 320 could be provided at any position along either side of the stretcher 20. It is understood that the power assist mechanism 300 could be configured so that when the handle 320 is pulled rather than pushed, the wire 344 is pulled to drive the drive wheel 302. To allow the drive wheel 302 to rotate freely when the stretcher 20 is moving, a ratchet mechanism or over-running clutch mechanism (not shown) similar to the one used in coaster bicycles can be coupled between the hub 350 and the drive wheel 302 which will allow the drive wheel 302 to rotate freely in both directions to facilitate steering of the stretcher 20 when the drive wheel 302 is not driven by the wire 344.

As previously described, this invention can be used alone or in conjunction with a fifth wheel steering system. The hand or foot operated power assist mechanism could be configured to drive the fifth wheel when it is lowered to engage the floor, or a separate drive wheel may be provided, which would be lowered to engage the floor and driven. If an additional drive wheel is used, the power assist mechanism is completely separate from the steering system, and therefore could be used on a stretcher with corner steer or no steering at all.

Although the present invention has been described with reference to particular embodiments, one skilled in the art can easily ascertain the essential characteristics of the present invention, and various changes and modifications can be made without departing from the spirit and scope of the invention as set forth in the following claims.

What is claimed is:

1. A patient support apparatus comprising:

a frame, a plurality of casters coupled to the frame for supporting the patient support apparatus on a floor, a patient support deck carried by the frame, a floor-engaging drive wheel coupled to the frame for rotation about a pivot axis, and a lever-actuated mechanism configured to mechanically drive the floor-engaging drive wheel rotatably about the pivot axis to move the patient support apparatus along the floor.

2. The patient support apparatus of claim 1, wherein the lever-actuated mechanism includes a wheel bracket movably coupled to the frame, wherein the drive wheel is coupled to the wheel bracket for rotation about the pivot axis, and wherein operation of the lever-actuated mechanism moves the wheel bracket from a first position in which the drive wheel is spaced apart from the floor to a second position in which the drive wheel engages the floor.

3. The patient support apparatus of claim 2, wherein the lever-actuated mechanism includes a foot pedal movably coupled to the frame and a cable coupled between the foot pedal and the drive wheel.

4. The patient support apparatus of claim 3, wherein the lever-actuated mechanism includes a return spring coupled between the wheel bracket and the frame to return the drive wheel, the wheel bracket and the foot pedal to their respective inoperative positions when the foot pedal is released.

5. A patient support apparatus comprising:

a frame, a patient support deck carried by the frame, a drive wheel coupled to the frame, and a lever-actuated mechanism configured to drive the drive wheel to move the patient support apparatus, the lever-actuated mechanism including a wheel bracket movably coupled to the frame, a foot pedal movably coupled to the frame and a cable coupled between the foot pedal and the drive wheel, and a return cable coupled between the wheel bracket and the frame to return the drive wheel, wheel bracket and the foot pedal to their respective inoperative positions when the foot pedal is released wherein the drive wheel is rotatably coupled to the bracket, and wherein operation of the lever-actuated mechanism moves the wheel bracket from a first position in which the drive wheel is spaced apart from a floor on which the patient support apparatus rests to a second position in which the drive wheel engages the floor, the drive wheel including a hub upon which the cable is at least partially wound, wherein the lever-actuated mechanism includes a pedal arm coupled to the foot pedal, wherein the cable has a first end coupled to the pedal arm and a second end coupled to the hub after the cable is partially wound around the hub, and wherein operation of the foot pedal pulls the cable off of the hub to cause the drive wheel to rotate and the patient support apparatus to move.

6. The patient support apparatus of claim 5, wherein the drive wheel includes a return spring that rotates the hub in a direction that rewinds the cable back onto the hub when the foot pedal is released and the drive wheel is lified off the floor.

7. The patient support apparatus of claim 6, wherein the lever-actuated mechanism includes a spring coupled between the pedal arm and the wheel bracket to lower the drive wheel to engage the floor when the foot pedal is pressed.

8. The patient support apparatus of claim 1, wherein the lever-actuated mechanism includes a foot pedal.

9. The patient support apparatus of claim 8, wherein the foot pedal is coupled to a rotatable shaft that rotates when the foot pedal is pressed, and the lever-actuated mechanism includes a flexible drive link coupled between the rotatable shaft and the drive wheel.

10. The patient support apparatus of claim 9, wherein the flexible drive link comprises a chain.

11. The patient support apparatus of claim 9, wherein the lever-actuated mechanism includes a drive sprocket coupled to the rotatable shaft and a driven sprocket coupled to the drive wheel, and wherein the flexible drive link extends between the drive sprocket and the driven sprocket.

12. The patient support apparatus of claim 11, wherein the drive wheel includes a hub upon which the flexible drive link is at least partially wound.

13. The patient support apparatus of claim 12, wherein the drive wheel further comprises a return spring that rotates the hub in a direction that rewinds the flexible drive link back onto the hub when the foot pedal is released and the drive wheel is lifted off the floor.

14. The patient support apparatus of claim 1, wherein the lever-actuated mechanism comprises a handle adjacent to the patient support deck.

15. The patient support apparatus of claim 14, wherein the lever-actuated mechanism further comprises a cable coupled between the handle and the drive wheel.

16. The patient support apparatus of claim 15, wherein the drive wheel includes a hub upon which the cable is at least partially wound.

17. The patient support apparatus of claim 16, wherein the drive wheel further comprises a return spring that rotates the hub in a direction that rewinds the cable back onto the hub when the handle is released and the drive wheel is lifted off the floor.

18. The patient support apparatus of claim 14, wherein the handle is positioned adjacent to an end of the patient support apparatus.

19. The patient support apparatus of claim 1, wherein the drive wheel functions as a steering wheel.

20. A method of moving a patient support apparatus supported on a floor by a plurality of casters, the method comprising the steps of:

providing the patient support apparatus with a floor-engaging drive wheel having a pivot axis, providing the patient support apparatus with a lever-actuated mechanism, and operating the lever-actuated mechanism to mechanically drive the floor-engaging drive wheel rotatably about the pivot axis to propel the patient support apparatus along the floor.

21. The method of claim 20, wherein the step of actuating the lever-actuated mechanism comprises pressing a foot pedal.

22. The method of claim 21, wherein the step of actuating the lever-actuated mechanism comprises operating a hand lever.

23. The method of claim 22, wherein the step of operating the hand lever comprises manually moving a handle which is positioned adjacent to the patient support deck.

24. A stretcher comprising:

a patient support, a plurality of casters for supporting the patient support for movement along a floor, and a power-assist mechanism comprising:

a floor-engaging drive wheel coupled to the patient support for rotation about a pivot axis, and an actuator coupled to the floor-engaging drive wheel, the actuator configured, when manually operated, to mechanically drive the floor-engaging drive wheel rotatably about the pivot axis to move the stretcher along the floor.

25. A stretcher upon which a patient rests comprising:

a patient support, a plurality of casters for supporting the patient support for movement along a floor in a desired direction by a caregiver pushing or pulling in said direction, a floor-engaging drive wheel coupled to the patient support for rotation about a pivot axis, and a manually operated power-assist mechanism configured to mechanically drive the floor-engaging drive wheel rotatably about the pivot axis to initiate motion of the patient support in said direction.

26. A stretcher comprising a patient support mounted upon casters for movement along a floor in a direction in which it is pushed or pulled, the stretcher comprising a floor-engaging drive wheel coupled to the patient support for rotation about a pivot axis, and a foot pedal-actuated mechanism configured to mechanically drive the floor-engaging drive wheel rotatably about the pivot axis to initiate motion of the patient support in said direction, the foot pedal-actuated mechanism being operably coupled between the floor-engaging drive wheel and the patient support.

27. A patient support apparatus comprising:

a frame, a plurality of casters coupled to the frame for supporting the patient support apparatus on a floor, a patient support deck carried by the frame, a drive wheel coupled to the frame and having a hub, and a lever-actuated mechanism including:

a wheel bracket movably coupled to the frame, the drive wheel being coupled to the wheel bracket for rotation about a pivot axis, a foot pedal movably coupled to the frame, a cable having a first end coupled to the foot pedal and a second end coupled to the hub after the cable is at least partially wound around the hub, and a return spring coupled between the wheel bracket and the frame, operation of the foot pedal moving the wheel bracket from a first position in which the drive wheel is spaced apart from the floor to a second position in which the drive wheel engages the floor, and in addition pulling the cable off of the hub to mechanically drive the floor-engaging drive wheel rotatably about the pivot axis to move the patient support apparatus along the floor, and the return spring returning the drive wheel, the wheel bracket and the foot pedal to their respective inoperative positions when the foot pedal is released.

* * * * *